US007901305B2

(12) United States Patent
Maeda

(10) Patent No.: US 7,901,305 B2
(45) Date of Patent: Mar. 8, 2011

(54) CATCHING MACHINE

(76) Inventor: Kohachiro Maeda, Osaka (JP)

( * ) Notice: Subject to any disclaimer, the term of this patent is extended or adjusted under 35 U.S.C. 154(b) by 0 days.

(21) Appl. No.: 12/374,961

(22) PCT Filed: Jul. 20, 2007

(86) PCT No.: PCT/JP2007/064336

§ 371 (c)(1),
(2), (4) Date: Jan. 23, 2009

(87) PCT Pub. No.: WO2008/013109

PCT Pub. Date: Jan. 31, 2008

(65) Prior Publication Data

US 2010/0004075 A1 Jan. 7, 2010

(30) Foreign Application Priority Data

Jul. 25, 2006 (JP) ..... 2006-202411

(51) Int. Cl.
*A63B 69/40* (2006.01)
*F41J 7/00* (2006.01)

(52) U.S. Cl. ..... 473/436; 473/455; 124/7

(58) Field of Classification Search ..... 473/431, 473/432, 434, 435, 436, 451–456
See application file for complete search history.

(56) References Cited

U.S. PATENT DOCUMENTS

| | | | | | |
|---|---|---|---|---|---|
| 1,086,067 | A | * | 2/1914 | McMillan | 473/436 |
| 1,223,386 | A | * | 4/1917 | Handelan | 473/436 |
| 1,523,747 | A | * | 1/1925 | Bradley | 273/391 |
| 2,082,818 | A | * | 6/1937 | Atwell | 473/436 |
| 2,657,058 | A | * | 10/1953 | Mulcahy | 473/436 |
| 3,194,556 | A | * | 7/1965 | Vinson | 473/436 |
| 3,306,613 | A | * | 2/1967 | Mainers | 473/436 |
| 4,524,749 | A | * | 6/1985 | Giovagnoli | 124/7 |
| 5,064,194 | A | * | 11/1991 | Bixler et al. | 473/436 |
| 5,133,548 | A | * | 7/1992 | Bedord et al. | 473/436 |
| 5,222,731 | A | * | 6/1993 | Hanabusa et al. | 473/436 |
| 5,573,239 | A | * | 11/1996 | Ryker et al. | 473/436 |
| 5,599,017 | A | * | 2/1997 | Bixler et al. | 473/436 |
| 6,155,936 | A | * | 12/2000 | Dorr | 473/456 |
| 7,662,053 | B1 | * | 2/2010 | Summers et al. | 473/431 |

FOREIGN PATENT DOCUMENTS

| | | | |
|---|---|---|---|
| JP | S55-005951 | U | 1/1980 |
| JP | 11155992 | A | 6/1999 |
| JP | 11299947 | A | 11/1999 |
| JP | 2000153011 | A | 6/2000 |
| JP | 2000350800 | A | 12/2000 |
| JP | 2002263233 | A | 9/2002 |
| JP | 2003079774 | A | 3/2003 |

OTHER PUBLICATIONS

International Search Report, PCT/JP2007/064336, Aug. 28, 2007, pp. 1-2.

* cited by examiner

*Primary Examiner* — Mark S Graham
(74) *Attorney, Agent, or Firm* — Ditthavong Mori & Steiner, P.C.

(57) ABSTRACT

A catching machine 5 that enables a pitcher to pitch a ball toward a predetermined target includes a ball collecting portion 20 for catching a ball pitched toward the target 11 and a ball returning portion 30 for returning the ball caught by the ball collecting portion 20 to the pitcher. The ball returning portion 30 includes a ball-return-distance setting device 32 for changeably setting a ball return distance.

9 Claims, 7 Drawing Sheets

CATCHING MACHINE

TECHNICAL FIELD

The present invention generally relates to a caching machine that enables a pitcher to practice pitching by himself/herself. More particularly, the present invention relates to a catching machine that enables a pitcher to practice pitching while having fun.

BACKGROUND ART

A conventional catching machine (pitching practice machine) is disclosed in, for example, Japanese unexamined patent publication No. 2002-263233. The catching machine according to Japanese unexamined patent publication No. 2002-263233 has a three-dimensional ball receiving portion and a display portion for displaying a strike count, a ball count, and a ball speed which are obtained when a flying ball hits the ball receiving portion located within a predetermined region.

The conventional catching machine is structured as described above. Although the conventional catching machine displays the counts and the ball speed during pitching, it is disadvantageous in that a pitched ball is not returned. Returning a pitched ball can be a solution to this problem. However, there has been a problem that a ball cannot be returned to an arbitrary position that is desired by a pitcher.

DISCLOSURE OF THE INVENTION

The present invention is made to solve the above problem and it is an object of the present invention to provide a catching machine capable of returning a ball to an arbitrary position that is desired by a pitcher.

A catching machine that enables a pitcher to pitch a ball toward a predetermined target according to the present invention includes: catching means for catching a ball pitched toward the target; and ball returning means for returning the ball caught by the catching means to the pitcher. The ball returning means includes ball-return-distance setting means for changeably setting a ball return distance.

The ball return distance can be changeably set to return the ball caught by the catching means to the pitcher. A catching machine capable of returning a ball to an arbitrary position desired by the pitcher can therefore be provided.

Preferably, the catching means includes holding means for holding a spare ball, and the ball returning means returns the spare ball.

More preferably, the target is divided into a plurality of regions and each of the divided regions is provided with display means for displaying when the pitched ball hits the region.

More preferably, the target is divided into a plurality of regions and each of the divided regions is provided with indicating means for indicating the region.

The indicating means may indicate the region with a light-emitting body. The catching machine may further include designating means for designating a pitching position in the target.

The catching machine may further include ball type determining means for determining a type of ball that is pitched by the pitcher.

Preferably, the catching machine further includes target-attaching-angle changing means for changing an angle at which the target is attached.

The catching machine may further include hitting detecting means for detecting when the ball hits the target. The catching means may include a ball stopping device for capturing the ball in order to prevent the ball from flying forward of the target. The catching machine may further include ball-stopping-device operating means for operating the ball stopping device when the hitting detecting means detects hitting of the ball.

BEST MODE FOR CARRYING OUT THE INVENTION

Figure 1:
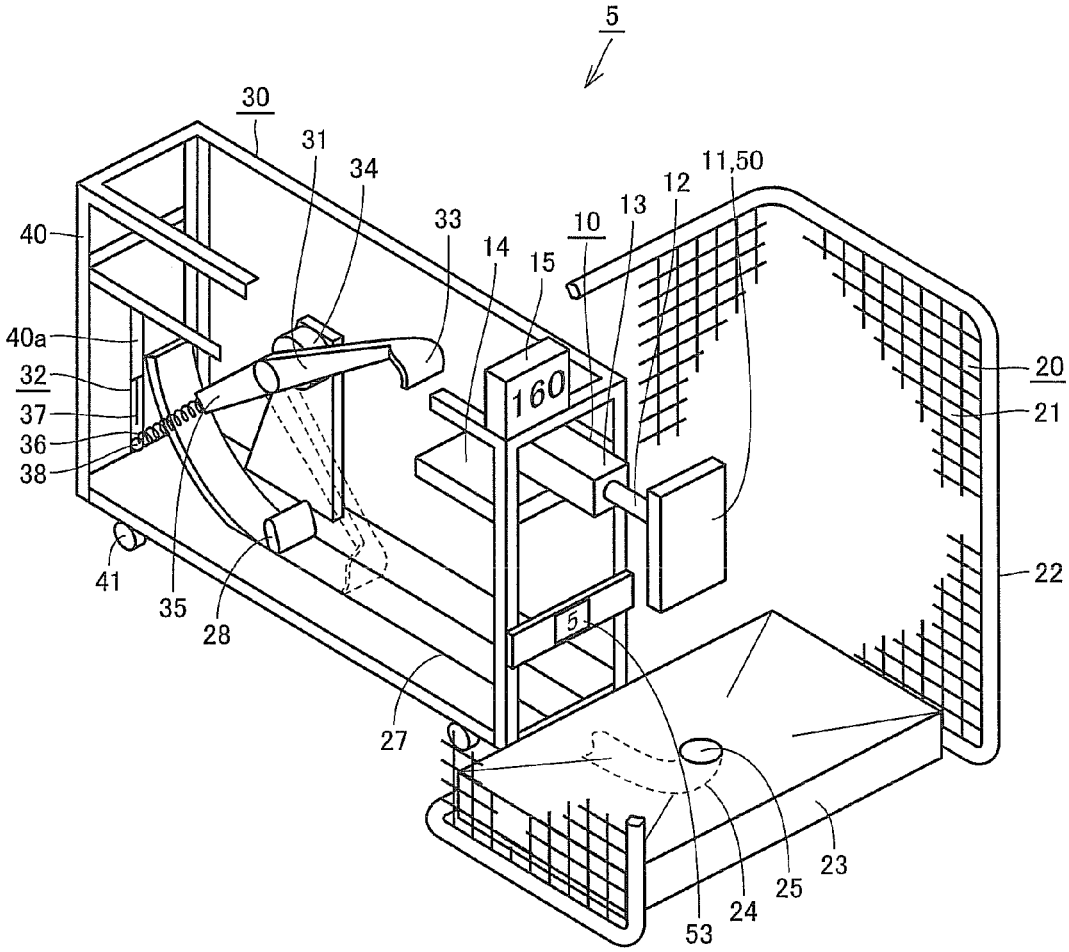
FIG. 1 is a perspective view showing an overall structure of a catching machine according to an embodiment of the present invention.
Figure 2:
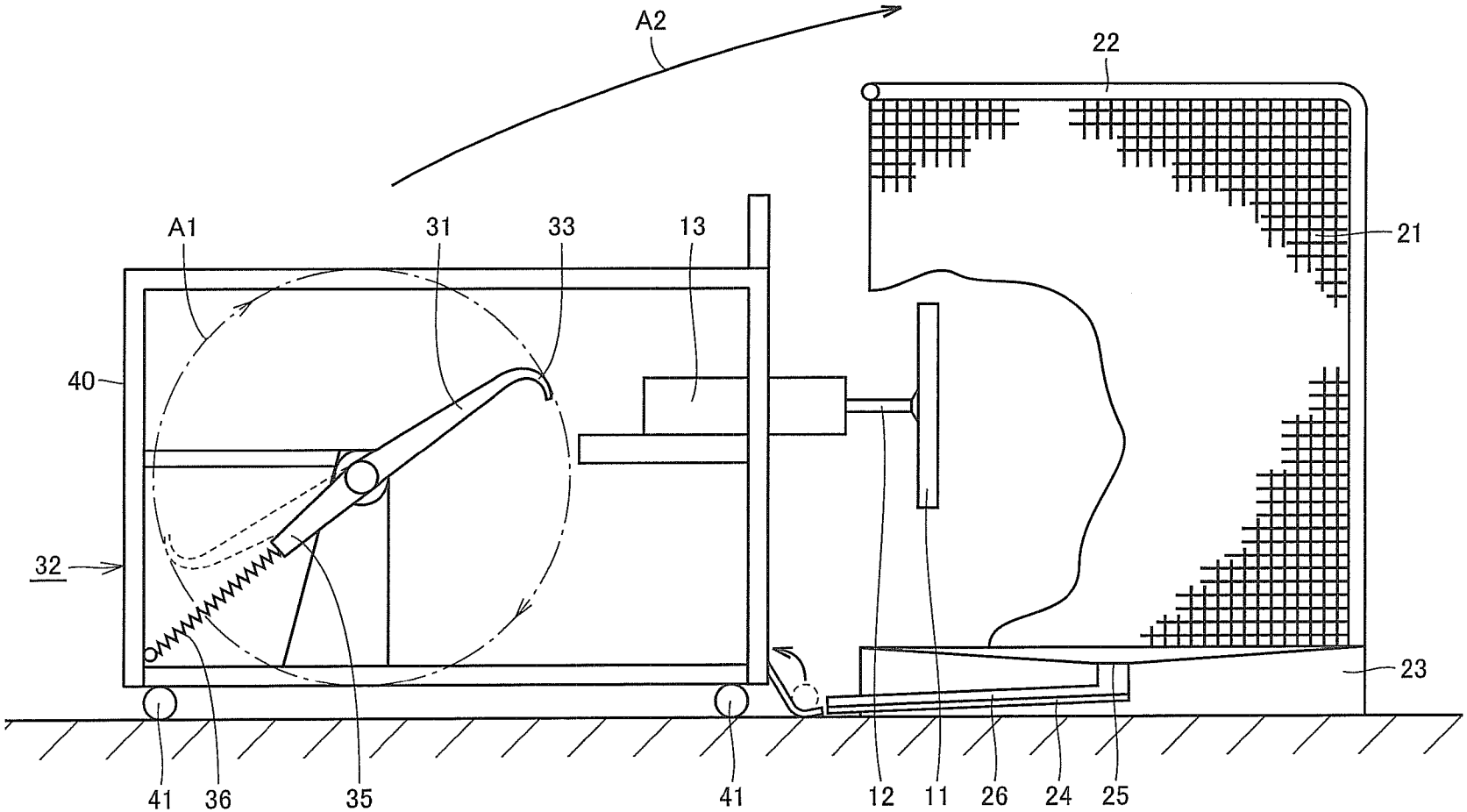
FIG. 2 is a side view of the catching machine according to the embodiment.

Hereinafter, an embodiment of the present invention will be described with reference to the accompanying drawings. FIG. 1 is a perspective view showing an overall structure of a catching machine according to the present invention. FIG. 2 is a side view of the catching machine when viewed from a lateral direction. Referring to FIGS. 1 and 2, a catching machine 5 includes a target portion 10 having a target 11 that serves as a pitching target for a pitcher, a ball collecting portion 20 corresponding to catching means, for collecting a ball hitting the target portion 10, and a ball returning portion 30 corresponding to ball returning means, for returning a ball collected by the ball collecting portion 20 to the pitcher. The target portion 10 and the ball collecting portion 20 are provided on a frame 40.

The target portion 10 includes the target 11 and a detecting portion 13 supporting the target 11 by a shaft 12 for detecting the speed of a ball hitting the target 11. The detecting portion 13 is held on a plate 14 provided on the frame 40. Note that the target 11 is movable in up-down and left-right directions by a not-shown target moving device provided on the plate 14. This movement is carried out by a not-shown remote control device.

The detecting portion 13 has a spring inside, and detects a pressing force applied to the spring and detects the speed of a ball based on the detected pressing force value. The detected ball speed is displayed on a display portion (display means) 15 provided on the frame 40. The display portion 15 will be described later. Note that detection of the ball speed is not limited to the above method, and may be carried out by any method.

The ball collecting portion 20 includes a net 21 that covers the side and back surfaces of the target portion 10 to prevent a pitched ball from flying outside, a net guard 22 for holding the net 21 at a predetermined position, and a ball receiving portion 23 provided under the target 11 for receiving the pitched ball. The ball receiving portion 23 has a predetermined height so as to have a first guide portion 24 for guiding the ball by using the difference in height. The ball receiving portion 23 is formed so as to have the lowest height in the middle so that the ball rolls from the peripheral portion to the middle. A hole 25 is provided in the middle. The hole 25 is connected to the first guide portion 24 and guides the ball to the ball returning portion 30 that will be described later. The ball receiving portion 23 has a rectangular parallelepiped shape extending by a predetermined length in front-back and left-right directions of the target 11. The first guide portion 24 forms a groove 26 having a semicircular cross section, and the ball is guided along the groove 26.

Note that a lower part of the net 21 is provided along the ball receiving portion 23.

The ball receiving portion 30 includes a ball returning arm 31 for returning a ball guided by the first guide portion 24 and a second guide portion 27 to the pitcher, and a ball-return-distance setting device (ball-return-distance setting means) 32 for arbitrarily setting a ball return distance of the ball returning arm 31. A stopper 28 for holding the guided ball is provided behind the second guide portion 27 (on the opposite side to the ball collecting portion 20).

The ball returning arm 31 has a ball shovel 33 at its end. The ball returning arm 31 returns a ball to the pitcher as shown by arrow A2 in FIG. 2 by placing the ball guided through the second guide portion 27 on the ball shovel 33 and rotating in the direction shown by arrow A1. The ball returning arm 31 is rotated by a motor 34 provided adjacent to the ball returning arm 31. Transmission of the rotation force from the motor 34 to the ball returning arm 31 is carried out by using a one-way cam clutch.

A spring 36 is provided at an opposite end 35 of the ball returning arm 31 to the ball shovel 33 in order to bias this end 35 to an obliquely downward direction. The use of the one-way cam clutch enables overrunning of the ball returning arm 31 by arbitrary switching the force of the motor 34 to the force of the spring 36.

The ball-return-distance setting device 32 includes a rail 37 provided at a rear end 40*a* of the frame 40 so as to extend in an up-down direction, and a metal fitting 38 provided so that it can be stopped at any position on the rail 37. The spring 36 described above is connected to the metal fitting 38. The length of the spring 36 is changed by changing the position of the metal fitting 38 on the rail 37. By thus changing the length of the spring 36, the rotation speed of the ball returning arm 31 can be changed and the ball return distance can be changed. Note that the frame 40 is supported by casters 41 provided at right front, right rear, left front, and left rear positions under the frame 40.

Figure 3:
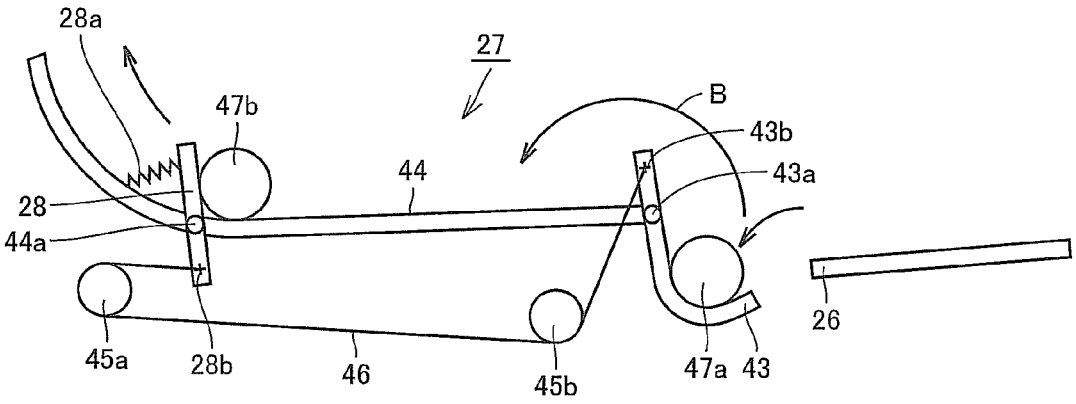
FIG. 3 is a schematic side view of a structure for guiding a ball from a first guide portion to a second guide portion.

A structure of guiding a ball from the first guide portion 24 to the second guide portion 27 will now be described. FIG. 3 is a schematic side view of the structure of guiding a ball from the first guide portion 24 to the second guide portion 27. Referring to FIG. 3, the second guide portion 27 includes a ball receiving portion 43 for receiving a ball conveyed by the groove 26 of the first guide portion 24 and a guide groove 44 connected to the ball receiving portion 43.

The ball receiving portion 43 is rotatable around a shaft 43*a* of the guide groove 44 in the direction shown by arrow B in the figure. The guide groove 44 is tilted downward from the ball receiving portion 43 toward a rear end located opposite to the ball receiving portion 43. The guide groove 44 extends upward in a circular arc shape on the rear end side. The stopper 28 rotatable around a shaft 44*a* of the guide groove 44 is provided on the guide groove 44 around the boundary between the horizontal portion of the guide groove 44 and the portion that rises in a circular arc shape. The stopper 28 holds a ball and the ball returning arm 31 returns the ball held by the stopper 28. The stopper 28 is biased upward by a spring 28*a* so as to protrude upward from the guide groove 44 and stop the ball.

A lower end 28*b* of the stopper 28 and an upper end 43*b* of the ball receiving portion 43 are connected to each other by a wire 46 through pulleys 45*a*, 45*b*. When the ball returning arm 31 pushes down the stopper 28 and returns the ball, the wire 46 at the lower end 28*b* of the stopper 28 is pulled rightward and the upper end 43*b* of the ball receiving portion 43 is pulled to the lower left direction. As a result, the ball receiving portion 43 rotates as shown by B in the figure, and the ball held by the ball receiving portion 43 is carried onto the guide groove 44. In the catching machine 5, it is thus preferable to use two balls, a ball 47*b* that is held by the stopper 28 and a ball 47*a* that is held by the ball receiving portion 43.

Operation of the catching machine 5 will now be described. A ball pitched by a pitcher hits the target 11. At this time, the ball speed is displayed on the display portion 15 as described above. After hitting the target 11, the ball falls and enters the hole 25 along the tilt of the ball receiving portion 23 and is then carried to the ball returning portion 30 by the first guide portion 24 and the second guide portion 27. The ball thus carried to the ball returning portion 30 is placed on the ball shovel 33 of the ball returning arm 31 and returned to the pitcher.

The distance to the pitcher is preset to a desired value by adjusting the length of the spring 36. The distance may be set by indicating the ball return distance beside the rail 37. Alternatively, the position of the metal fitting 38 may be electrically movable so that the ball return distance can be set by operating a not-shown remote control device.

Figure 4:
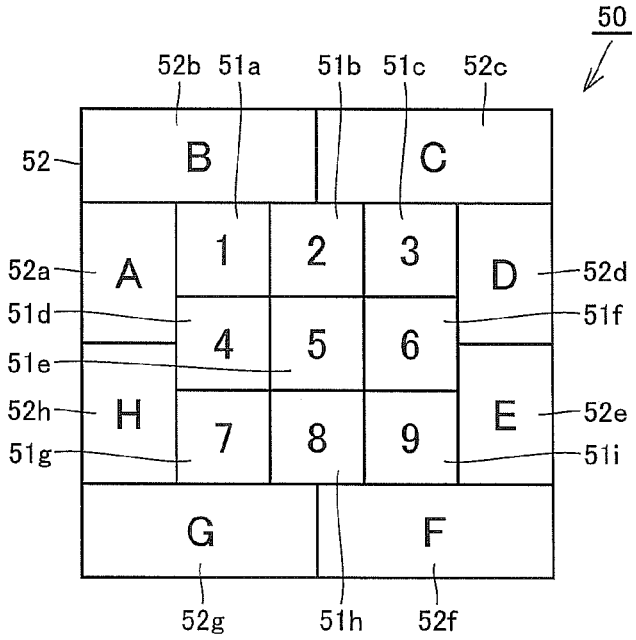
FIG. 4 is a front view showing another example of a front view of a target.

A modification of the target will now be described. FIG. 4 shows a modification of the target. Referring to FIG. 4, a target 50 of this embodiment includes a central portion 51 and a peripheral portion 52 surrounding the central portion 51. The central portion 51 basically has the same size as that of the target 11 of the above embodiment. The central portion 51 is divided into three by three and therefore includes nine divided regions 51*a* through 51*i*. Preferably, the regions 51*a* through 51*i* are numbered (1 through 9 in the figure) as indicating means. The indicating means may be a light-emitting body indicating the numbers. The peripheral portion 52 is divided into two regions in a lateral direction in its upper and lower parts and into two regions in a longitudinal direction in its right and left parts. The peripheral portion 52 is thus divided into eight regions 52*a* through 52*h*. Preferably, the regions 52*a* through 52*h* are also numbered. The regions 52*a* through 52*h* are marked with A through H in the figure. The regions 51*a* through 51*i* and the regions 52*a* through 52*h* can independently detect when hit by the ball.

In general, it is preferable that the central portion 51 corresponds to a so-called strike zone and the peripheral portion 52 has a width that is about one and a half times as large as the diameter of the ball to be used.

A pitching indicating portion 53 serving as designating means is provided adjacent to the target 50 (behind the target 50 on the frame 40 and under the target 50 in FIG. 1). The pitching indicating portion 53 indicates a pitching position in the target 50 to the pitcher. In other words, the pitching indicating portion 53 indicates the pitching position by a region number provided on the target 50 as described above. For example, when the region 51*e* marked with "5" in the central portion of the target 50 is indicated, the pitcher can pitch a ball aiming at the region 51*e*. By setting the number arbitrarily, the pitcher can practice pitching while having more fun. Note that the pitching indicating portion 53 may be a liquid crystal panel or the like and the contents indicated by the pitching indicating portion 53 may be changed by a remote control device.

A light-emitting body such as an LED may be provided in each region so that the region indicated by the pitching indicating portion 53 emits light.

When the pitcher practices pitching, the number of balls to be pitched may be set, and the number of balls pitched, the regions on the target 50 which have been hit by the ball pitched by the pitcher, the rate of successful pitching to the regions indicated by the pitching indicating portion 53, and the like may be displayed on the display portion 15. In this case, the number of balls to be pitched and the contents to be displayed on the display portion 15 may be set by a not-shown remote control device.

In this way, the pitcher can more clearly know the target position the pitcher is to aim at and pitcher's ball control ability. In the case where there are spectators or the like, the spectators or the like can also know the target position the pitcher is to aim at, whereby many people can enjoy pitching practice together.

As a structure capable of independently detecting a ball hitting the regions 52*a* through 52*h* of the peripheral region 52, each region may be rotatable around one side of the longitudinal direction so that the region is rotated when hit by a ball. Whether or not a ball hit the region or not can thus be known easily. This structure may be used in each region of the central portion 51.

Figure 5:
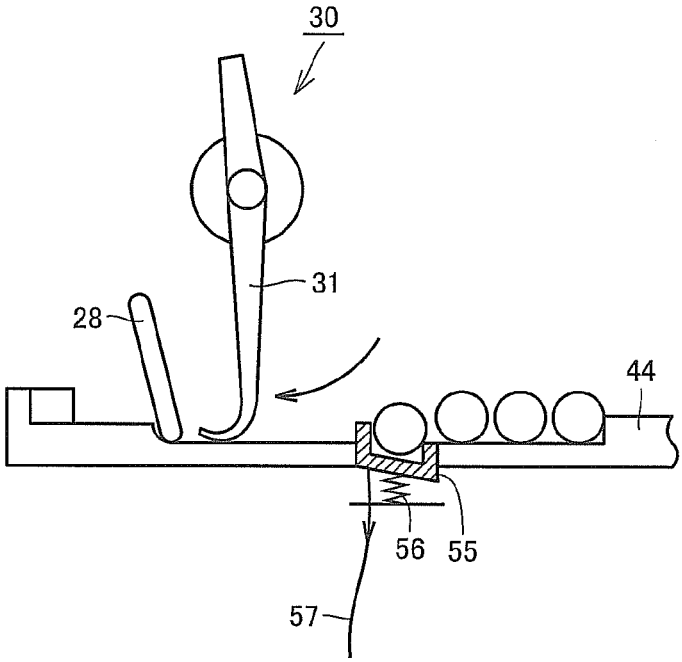
FIG. 5 is a diagram showing another example of a ball returning portion.

Another example of the ball returning portion 30 will now be described. FIG. 5 is a diagram showing another example of the ball returning portion 30. In the above embodiment, only two balls are circulated between the pitcher and the catching machine as shown in FIG. 3 on the assumption that the pitcher will reliably pitch a ball inside the net. In fact, however, the ball pitched by the pitcher may fly outside the net 21. In this embodiment, the ball returning portion 30 can hold a plurality of balls as spare balls in order to deal with such a case.

Referring to FIG. 5, in this embodiment, the guide groove 44 of the second guide portion 27 shown in FIG. 3 serves as holding means for holding a plurality of balls, and a stopper 55 for preventing the balls from moving toward the ball returning arm 31 is provided in a part of the guide groove 44. The stopper 55 is biased upward by a spring 56. When a ball-return button on a not-shown remote control portion is pressed, a wire 57 pulls the spring 56 downward, whereby the ball is supplied to the ball returning arm 31. A front part of the stopper 55, a part to which the balls are supplied, protrudes to a position lower than the bottom surface of the guide groove 44, and a rear part of the stopper 55 protrudes to a position higher than the bottom surface of the guide groove 44. The stopper 55 has a protruding portion between the front part and the rear part, which is capable of holding only one ball. Balls are supplied one by one to the ball returning arm 31 by moving the protruding portion up and down against the spring for a predetermined time by the wire 57.

Description will now be given to the case where a ball stopping device is provided in the ball collecting portion 20. FIG. 6(A) is a schematic side view of the ball collecting portion 20 and FIG. 6(B) is a diagram showing in detail a main part of the ball collecting portion 20. Referring to FIGS. 6(A) and 6(B), a ball stopping device 60 is provided to the respective lower parts of both ends in a width direction on the pitcher side of the net guard 22. The ball stopping device 60 includes a ball stopping net 61 provided between both ends in the width direction on the pitcher side of the net guard 22 and a ball-stopping-net holding portion 62 for holding both ends in the width direction and the bottom part of the ball stopping net 61. Note that the ball-stopping-net holding portion 62 may also hold the top part of the net 61. When the pitcher pitches a ball to the target 11 and the ball is bounced from the target 11 forward to the ball stopping net 61 as shown by arrow C in FIG. 6(A), the ball stopping net 61 falls to the target 11 side as shown by arrow D in FIG. 6(B). The ball stopping device 60 thus prevents the ball from going outside the ball collecting portion 20.

Figure 6:
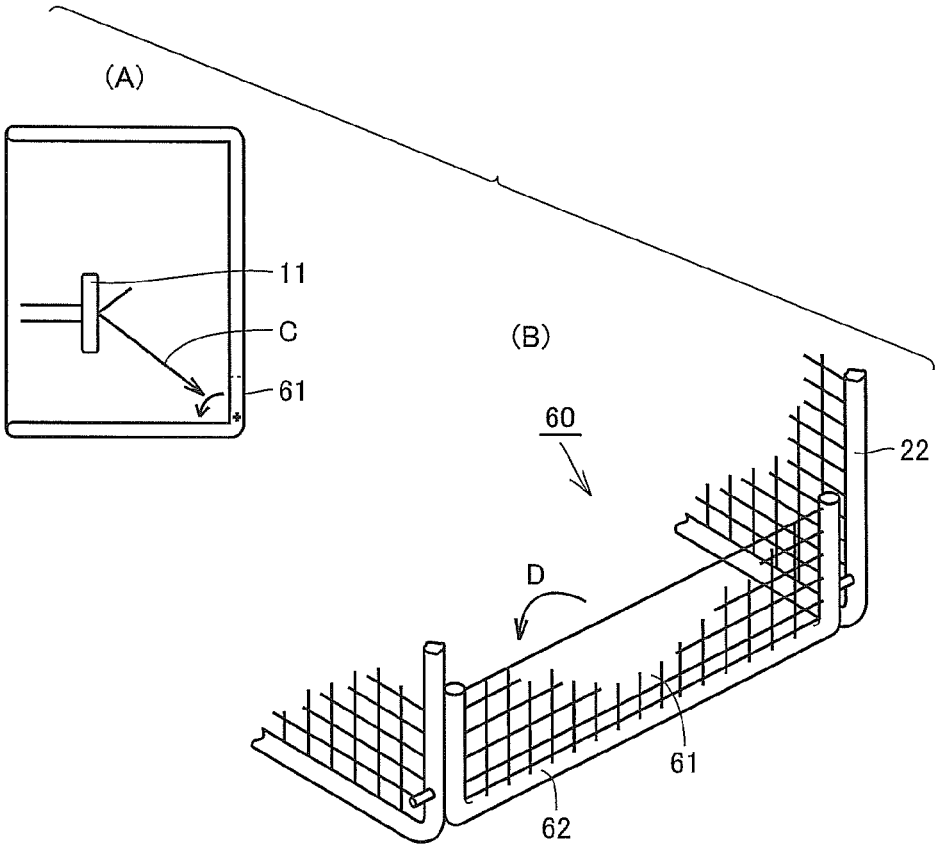
FIG. 6 show diagrams showing in detail a main part of a ball collecting portion.
Figure 7:
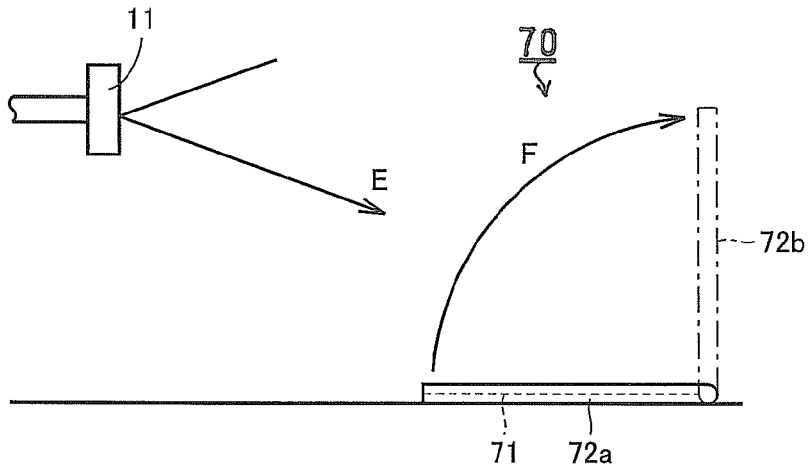
FIG. 7 is a diagram showing another embodiment of the ball collecting portion.

Another embodiment of the ball stopping device will now be described. FIG. 7 is a schematic side view of the ball collecting portion 20 and shows the same portion as that of FIG. 6(A). In the above embodiment, the ball stopping device includes the ball stopping net 61 and the ball-stopping-net holding portion 62 for holding both ends in the width direction and the bottom part of the ball stopping net 61, and the ball stopping net 61 falls to the target 11 side when the ball hits the target 11. In this embodiment, on the other hand, a ball stopping net 71 (which is held by a ball-stopping-net holding portion 72 as in the case of FIG. 6) initially falls to the target 11 side. When the ball hits the target 11 as shown by E in the figure, the ball-stopping-net holding portion 72 rises as shown by F in the figure. Note that, in this embodiment, the ball stopping device 70 basically has the same structure as that of the ball stopping device 60 in FIG. 6. Whether the ball hit the target 11 or not is detected by the detecting portion 13. The detecting portion 13 therefore operates as hitting detecting means. The ball-stopping-net holding portion 72 is always biased by a not-shown spring so as to rise upward as shown by 72*b* along F in the figure, and is caused to contact the ground side by a not-shown engaging device as shown by 72*a* in the figure. When the detecting portion 13 detects hitting of the ball, engagement of the engaging device is released by a not-shown mechanism and the ball-stopping-net holding portion 72 rises as shown by 72*b*. The not-shown spring and the not-shown engaging device function as ball-stopping-device operating means. Note that the embodiment shown in FIG. 6 may operate in the same manner.

Note that the target 11 is attached so that the surface thereof extends in a vertical direction. However, the present invention is not limited to this, and the angle between the surface of the target 11 and the vertical direction may be adjustable by using a not-shown adjusting device.

In the above embodiment, description is given to the case where the ball stopping net is caused to fall or rise. However, the present invention is not limited to this, and the ball stopping net may be structured so as to rise vertically upward from the ground side.

Figure 8:
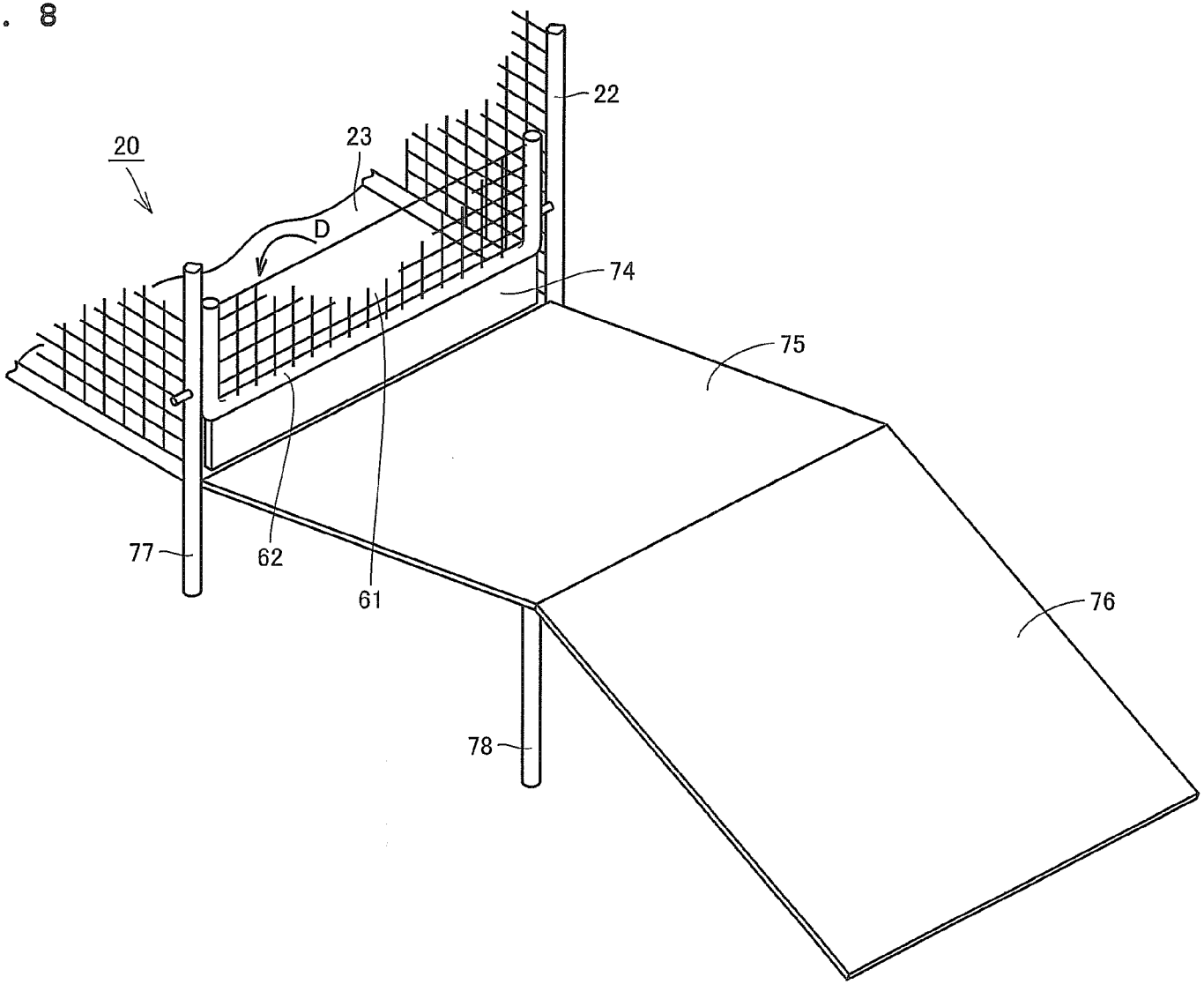
FIG. 8 is a diagram showing still another embodiment of the ball collecting portion.

Another embodiment of the ball stopping device will now be described. FIG. 8 is a perspective view showing a front direction of the ball collecting portion 20 of this embodiment, and shows a front part of the ball receiving portion 23 shown in FIG. 1. In this embodiment, a first auxiliary plate 75 and a second auxiliary plate 76 are provided continuously in front of the ball receiving portion 23. A ball stopping net 61 and a net holding portion 62 which are the same as those of FIG. 6 are provided in the front part of the ball receiving portion 23. The ball stopping net 61 and the net holding portion 62 are provided at a position higher than that shown in FIG. 6, and a ball stopping portion 74 is provided under the net holding portion 62. The ball stopping portion 74 is provided so as to fill the gap between the net holding portion 62 and the ball receiving portion 23. The ball stopping portion 74 is pivotable around its upper end so that the lower end of the ball stopping portion 74 pivots only from a position facing vertically downward toward the ball receiving portion 23. Accordingly, when a ball bounced from the target 11 hits the lower part of the ball receiving net 61, the ball is guided to the ball receiving portion 23.

The respective heights of legs 77, 78 of the ball collecting portion 20 are set so that the first auxiliary plate 75 becomes lower on the ball receiving portion 23 side and higher on the front side. The second auxiliary plate 76 contacts the ground on its front side. Therefore, a ball bounced from the target 11 beyond the ball stopping net 61 may hit the first auxiliary plate 75 and return toward the ball receiving portion 23.

As described above, the ball stopping portion 74 opens only to the ball receiving portion 23 side. Therefore, a ball located on the first auxiliary plate 75 rolls on the first auxiliary plate 75 along the tilt and is collected by the ball receiving portion 23. Note that the ball that hits the second auxiliary plate 76 or is located on the second auxiliary plate 76 rolls toward the front side. A guide plate may be provided in a height direction at both side ends of the first and second auxiliary plates 75 and 76.

Figure 9:
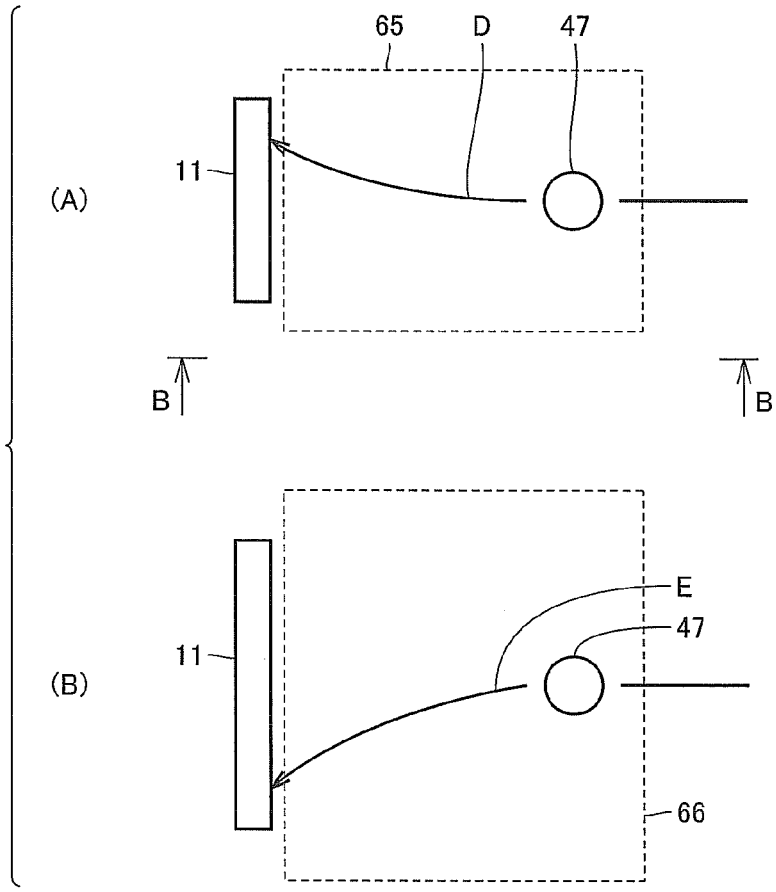
FIG. 9 show diagrams of the states in which ball movement in front of the target is detected.

Still another embodiment of the present invention will now be described. FIG. 9 shows diagrams illustrating still another embodiment of the present invention. FIG. 9(A) is a top plan view of the target 11 of FIG. 1 and FIG. 9(B) is a side view when viewed from the direction shown by arrow B-B in FIG. 9(A). Referring to FIG. 9, a ball 47 curves rightward (the direction shown by D in the figure) in a horizontal direction and curves downward (the direction shown by E in the figure) in a vertical direction. In order to detect such a moving direction of the ball, a sensor for detecting ball movement in a range shown by dotted lines 65, 66 in the figure is provided on a front upper part and a side surface of the target 11 as ball type determining means. Any sensor can be used as long as the sensor can detect ball movement. The pitcher can thus determine whether or not the pitcher could pitch a desired type of ball.

Note that, in the above embodiment, description is given to the case where the pitcher performs normal pitching. However, the present invention is not limited to this. The pitcher may do a warm-up before normal pitching. In other words, a person who practices pitching before normal pitching can set a warm-up. This setting is carried out by a not-shown remote control device.

When a person who practices pitching sets a warm-up, display of "doing a warm-up" is provided on the display portion 15. The number of balls to be pitched as a warm-up can be set, and the preset number of balls to be pitched, the remaining number of balls to be pitched, and the like may be displayed.

Note that, in the above embodiment, description was given to the case where the ball return distance is set by adjusting the length of the spring. However, the present invention is not limited to this, and another method may be used.

Although embodiments of the present invention have been described above with reference to the figures, the present invention is not limited to the illustrated embodiments. Various modifications and variations can be made to the above illustrated embodiments within the same scope as, or an equivalent scope to, the present invention.

INDUSTRIAL APPLICABILITY

The catching machine of the present invention is capable of changeably setting a ball return distance when a pitched ball is returned to a pitcher. The catching machine of the present invention is therefore advantageously used as a catching machine.

What is claimed is:

1. A catching machine that enables a pitcher to pitch a ball toward a predetermined target, comprising: catching means for catching a ball pitched toward the target; and ball returning means for returning the ball caught by the catching means to the pitcher, wherein the ball returning means includes ball-return-distance setting means for changeably setting a ball return distance, the ball-return-distance setting means includes a ball returning arm having a ball shovel for holding the ball and rotatable around a predetermined shaft, and a spring connected to an opposite end of the ball returning arm from the ball shovel, and the ball return distance is changed by adjusting a length of the spring, wherein a first ball is supplied to the ball returning arm after being held by a ball receiving portion and a guide groove is connected to the ball receiving portion, the guide groove has a stopper for holding the first ball, the ball returning arm holds the first ball and by touching the stopper moves the stopper when rotating along the guide groove, and a second ball held by the ball receiving portion is carried to the guide groove as the stopper is moved.

2. The catching machine according to claim 1, wherein the catching means includes holding means for holding a spare ball, and the ball returning means returns the spare ball.

3. The catching machine according to claim 1, wherein the target is divided into a plurality of regions and each of the divided regions is provided with display means for displaying when the pitched ball hits the region.

4. The catching machine according to claim 1, wherein the target is divided into a plurality of regions and each of the divided regions is provided with indicating means for indicating the region.

5. The catching machine according to claim 4, wherein the indicating means indicates the region with a light-emitting body.

6. The catching machine according to claim 1, further comprising designating means for designating a pitching position in the target.

7. The catching machine according to claim 1, further comprising ball type determining means for determining a type of ball that is pitched by the pitcher.

8. The catching machine according to claim 1, further comprising target-attaching-angle changing means for changing an angle at which the target is attached.

9. The catching machine according to claim 1, further comprising hitting detecting means for detecting when the ball hits the target, wherein the catching means includes a ball stopping device for capturing the ball in order to prevent the ball from flying forward of the target, the catching machine further comprising ball-stopping-device operating means for operating the ball stopping device when the hitting detecting means detects hitting of the ball.

* * * * *